United States Patent [19]

Watson

[11] 4,318,347

[45] Mar. 9, 1982

[54] SHIFTABLE PARTICLE SPHEROIDAL SIDE BEARING

[75] Inventor: Thomas H. Watson, Bonita, Calif.

[73] Assignee: Pullman Incorporated, Chicago, Ill.

[21] Appl. No.: 116,684

[22] Filed: Jan. 30, 1980

[51] Int. Cl.[3] ..... B60G 21/04; B61F 5/14; B61F 5/24

[52] U.S. Cl. ..... 105/199 CB; 308/138; 308/225

[58] Field of Search ..... 105/199 R, 199 C, 199 S, 105/199 CB; 308/137, 138, 225

[56] References Cited

U.S. PATENT DOCUMENTS

| | | | |
|---|---|---|---|
| 426,701 | 4/1890 | Ashmead | 308/225 |
| 702,896 | 6/1902 | Williams, Jr. | 308/225 |
| 710,609 | 10/1902 | Pungs | 308/225 |
| 713,183 | 11/1902 | Wands | 308/225 |
| 1,973,816 | 9/1934 | Kruckenberg et al. | 105/199 S X |
| 3,670,661 | 6/1972 | Pangalila | 105/199 CB X |
| 3,719,152 | 3/1973 | Harter | 105/199 R X |
| 3,719,154 | 3/1973 | Reynolds | 105/199 CB |
| 3,915,520 | 10/1975 | Hassenauer | 105/199 CB X |

FOREIGN PATENT DOCUMENTS

| | | | |
|---|---|---|---|
| 79935 | 3/1934 | Sweden | 105/199 CB |

*Primary Examiner*—Robert R. Song
*Assistant Examiner*—Howard Beltran
*Attorney, Agent, or Firm*—Paul A. Kerstein

[57] ABSTRACT

A side bearing assembly for railway rolling stock having an elastomeric body, containing granular solid substance, disposed between the body bolster and the truck bolster or side frame. The assembly is an inexpensive yet durable means for accomplishing increased support of static and dynamic loads without inhibiting the body bolster movement in a horizontal plane relative to its trucks.

8 Claims, 4 Drawing Figures

SHIFTABLE PARTICLE SPHEROIDAL SIDE BEARING

BACKGROUND OF THE INVENTION

1. Field of the Invention

The present invention relates to a side bearing assembly for railway vehicles wherein an elastomeric bag containing granular solid material improves vertical and horizontal load carrying capabilities.

2. Description of the Prior Art

The prior art includes that shown by the following U.S. Patents.

U.S. Pat. No. 3,915,520 discloses means for converting a roller side bearing to a constant contact resilient side bearing by the inclusion of elastomeric pads.

U.S. Pat. No. 3,719,154 reveals an elastomeric body partially situated in a channel member between the body and truck bolsters. U.S. Pat. No. 3,670,661 shows various arrangements of resilient material, coil springs and steel cylinders serving as side bearings.

U.S. Pat. No. 1,973,816 discloses an embodiment encompassing rubber rollers as side bearings. In the various modifications of the rubber rollers, FIGS. 3–6 of this patent show how return forces of the vehicle to its mid-position can be accomplished. In another embodiment of the invention a hollow body can be filled with compressed air as shown in FIG. 7. In the same vein U.S. Pat. No. 3,719,152 shows side bearings as chambers containing fluid and having the capability of flow under pressure between a reservoir tank and other side bearings.

SUMMARY OF THE INVENTION

The present invention relates to a rolling bladder side bearing of economical construction yet durable enough to handle the great static and dynamic loads encountered during railway vehicle operation. Railway rolling stock has long been played by lateral swaying movement known as rock and roll. Excessive lateral swaying can cause vehicle damage and even derailment. The problem of rock and roll increases and becomes more apparent as the size and speed of railway vehicles increase.

Thus, various arrangements located between the body and truck bolster have been tried to limit rock and roll in railway vehicles. In attempting to overcome the problem it must be remembered that the body bolster must be able to move in a horizontal plane relative to its truck bolsters in order to negotiate curves and turns.

The object of the invention is to provide vertical support and limit rock and roll while providing for swivel of the truck bolster beneath the car body bolster. This is accomplished in the present invention by an elastomeric bag filled with a low shear, high compressive strength, fine granular material, such as steel shot or the like. The filled elastomeric bag is attached between the truck bolster and car body bolster. As a railway vehicle negotiates a curve the elastomeric bag acts in a horizontal plane. It rolls along the top of the truck bolster and the underside of the car body bolster up to its limits of motion. The load is taken through the granular material inside the bag. To limit rock and roll and provide vertical support without distribution horizontally, the elastomeric bag acts in a vertical plane limiting the swaying motion and supporting loads through the granular material inside the bag. This permits the elastomeric bag to be a non-structural component utilized to simply contain the granular material and for attaching to the truck and car body bolster.

DESCRIPTION OF THE PREFERRED EMBODIMENT

Figure 1:
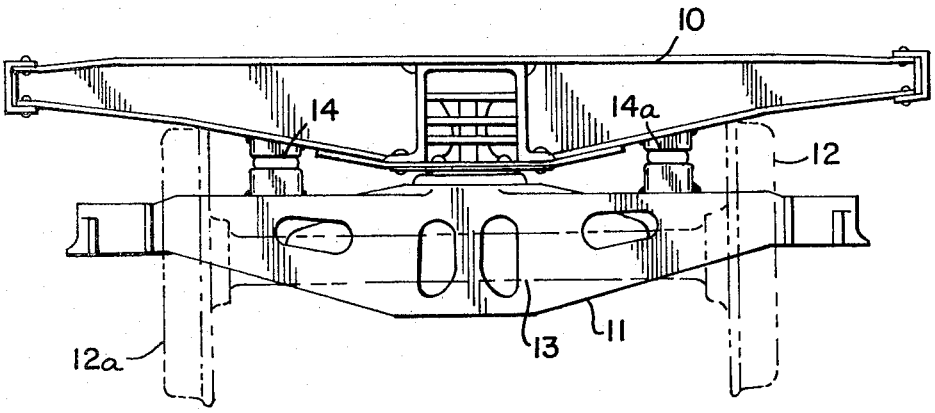
FIG. 1 is an end elevational view of a truck bolster and car body bolster with the embodiment of the invention mounted thereon.
Figure 2:
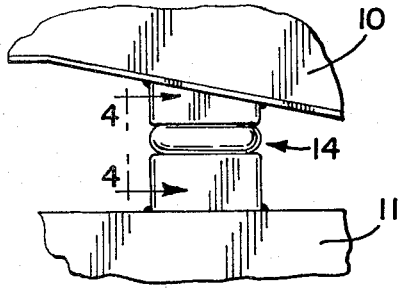
FIG. 2 is an enlarged view of the embodiment.
Figure 3:
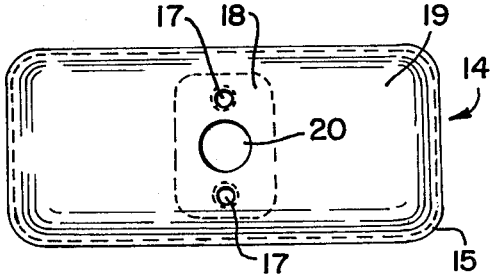
FIG. 3 is a top plan view of the embodiment.
Figure 4:
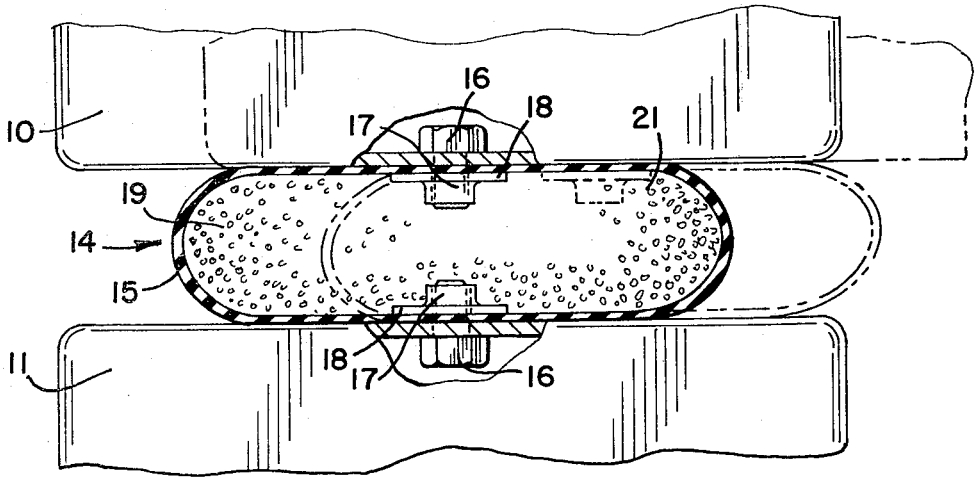
FIG. 4 is a view taken along line 4—4 of FIG. 2 showing the embodiment in section and its movement in phantom.

FIG. 1 discloses a car body bolster 10 mounted on a truck bolster 11 having wheels 12 and **12*a* connected to an axle 13 (shown in phantom). Roller bladder side bearings 14 and 14*a* are attached to the top of the truck bolster 11 and the bottom of the car body bolster 10. It should be noted that the side bearing location can be on the truck side frame as well. As best shown in FIGS. 3 and 4 the roller bladder side bearing 14 includes an elastomeric outer covering 15 being abrasion resistant for long life. The outer covering 15 is connected to the bottom of the car body bolster 10 and the top of the truck bolster 11 by a plurality of threaded connectors 16. The connectors 16 thread into threaded receivers 17 of an accepting plate 18, located within a cavity 19 formed by the outer covering 15**.

A fillport 20 is disposed at the top of the side bearing 14 allowing access to the cavity 19. Through the fillport 20 a high strength low shear force granular material 21 is introduced. The material 21 may be balls, steel shot or the like that has a high compressive strength to support vertical loads while having a low coefficient of friction allowing the grains of material to slide past one another. As further illustrated in FIG. 4 and shown in phantom is the movement of the roller bladder side bearing 14 during cornering. While negotiating a curve the car body bolster 10 is caused to shift, its maximum position being shown as 10'. The side bearing 14 correspondingly rolls, to its maximum roll being shown as 14'.

The granular material 21 is subjected to high vertical loads during operation. These loads are somewhat distributed through the material 21 without exerting the forces on the elastomeric covering 15. The side bearing may also have some internal pressure, but not to solely carry the loads. In addition to supporting large loads each grain of granular material provides a surface of low friction allowing the side bearing 14 to move in a horizontal plane with the least amount of friction. It may also be desirable to introduce a lubricant to decrease the friction between grains of the material 21.

Modifications and variations of the present invention are possible in light of the above teachings. It is, therefore, to be understood that within the scope of the appended claims, the invention may be practiced otherwise than as specifically described.

What is claimed is:

1. In a railway car having a car body including body bolsters, car trucks including truck bolsters, center plate means connecting said bolsters for relative swivelling movement, the improvement of side bearing assemblies connected to said bolsters on opposite sides of said center plate means, comprising:

a flexible hollow spheriod member having an inner cavity including an access port, a plurality of granular particles within said cavity, said hollow member including upper and lower interconnected wall portions respectively connected to said body and truck bolsters wherein lateral forces are constrained during movement of said truck bolsters relative to said body bolsters, and said granular particles substantially completely filling said hollow member and in contact with one another and providing means by compaction for resisting vertical load forces encountered during relative movements of said body bolster and truck bolster.

2. The side bearing assembly in accordance with claim 1, said flexible hollow member being elastomeric and abrasion resistant.

3. The side bearing assembly in accordance with claim 2, said granular particles having high compressive strength.

4. The side bearing assembly in accordance with claim 3, said granular particles having a low coefficient of friction.

5. The side bearing assembly in accordance with claim 4, said granular particle being balls as steel shot.

6. The side bearing assembly in accordance with claim 5, said wall portions comprising a plurality of accepting plates disposed within said inner cavity having a plurality of female threaded means, and a plurality of male threaded means extended through said car body and truck bolster into said female threaded means of said wall portions.

7. The side bearing assembly in accordance with claim 6, and a lubricant commingled with said granular particles for reducing the coefficient of friction therebetween.

8. The side bearing assembly in accordance with claim 7, and said member being at least partially internally pressureized.

* * * * *